US010436228B2

(12) United States Patent
Kemnitz et al.

(10) Patent No.: US 10,436,228 B2
(45) Date of Patent: Oct. 8, 2019

(54) ELECTRO-HYDRAULIC MACHINE WITH INTEGRATED SENSOR

(71) Applicants: Rausch & Pausch GmbH, Selb (DE); Eckerle Technologies GmbH, Malsch (DE)

(72) Inventors: Rocco Kemnitz, Bobenneukirchen (DE); Jörg Bauer, Selb (DE); Ernst Fleischmann, Rehau (DE); Alexander Dümler, Mitterteich (DE); Frank Lauterbach, Höchstädt (DE); Dominik Ketterer, Ubstadt-Weiher (DE)

(73) Assignees: Rausch & Pausch GmbH, Selb (DE); Eckerle Technologies GmbH, Malsch (DE)

( * ) Notice: Subject to any disclaimer, the term of this patent is extended or adjusted under 35 U.S.C. 154(b) by 128 days.

(21) Appl. No.: 15/668,000

(22) Filed: Aug. 3, 2017

(65) Prior Publication Data

US 2018/0038395 A1 Feb. 8, 2018

(30) Foreign Application Priority Data

Aug. 5, 2016 (DE) ..... 10 2016 114 540

(51) Int. Cl.
*F15B 21/08* (2006.01)
*E02F 9/20* (2006.01)
(Continued)

(52) U.S. Cl.
CPC ..... *F15B 21/087* (2013.01); *E02F 9/2095* (2013.01); *F04C 2/101* (2013.01); *F04C 11/008* (2013.01); *F15B 11/024* (2013.01); *F04C 2240/803* (2013.01); *F04C 2240/808* (2013.01); *F04C 2240/81* (2013.01);
(Continued)

(58) Field of Classification Search
CPC ..... F04C 11/008; F04C 2240/808; F04C 2240/81
See application file for complete search history.

(56) References Cited

U.S. PATENT DOCUMENTS 8,004,135 B2 * 8/2011 Peterson ..... H02K 11/33 310/156.05
10,087,932 B2 * 10/2018 Huang ..... F04C 15/008
(Continued)

FOREIGN PATENT DOCUMENTS

DE 102015119083 A1 5/2016

OTHER PUBLICATIONS

European Search Report dated Nov. 20, 2017, in corresponding European Application No. 17183685.1 (7 pgs.).

*Primary Examiner* — Thomas E Lazo
(74) *Attorney, Agent, or Firm* — Maier & Maier, PLLC

(57) ABSTRACT

An electro-hydraulic motor-pump unit, MPU, having a pump for conveying a hydraulic fluid in a hydraulic system, an electric motor coupled to the pump for driving, a control coupled to the electric motor and arranged for actuating and/or feedback-controlling the electric motor, and a housing, wherein at least one sensor is disposed in a sensor receiving means integrated in the housing and is electrically connected with the control. Additionally, the invention relates to a hydraulic system comprising hydraulic lines and connected to the hydraulic lines an MPU of the invention with at least one integrated pressure sensor.

16 Claims, 7 Drawing Sheets

Figure 1:
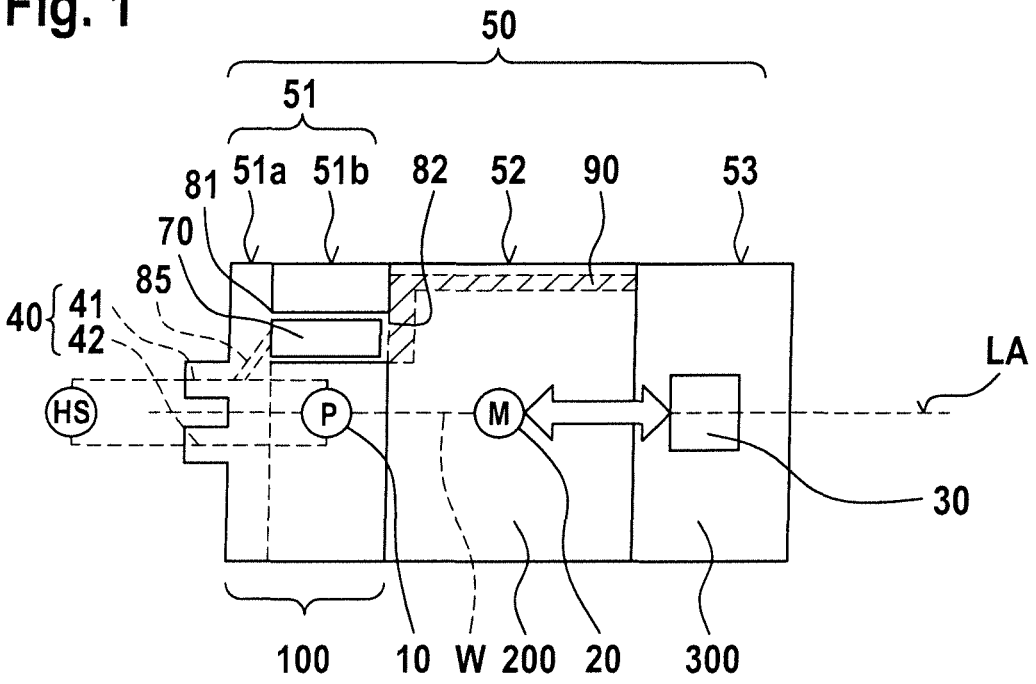

(51) Int. Cl.
*F15B 11/024* (2006.01)
*F04C 2/10* (2006.01)
*F04C 11/00* (2006.01)

(52) U.S. Cl.
CPC ..... *F04C 2270/185* (2013.01); *F15B 2211/20515* (2013.01); *F15B 2211/20546* (2013.01); *F15B 2211/50518* (2013.01)

(56) References Cited

U.S. PATENT DOCUMENTS

| | | | | |
|---|---|---|---|---|
| 2008/0075608 | A1 | 3/2008 | Suzuki | |
| 2008/0174213 | A1* | 7/2008 | Peterson | H02K 11/215 310/68 R |
| 2011/0293450 | A1* | 12/2011 | Grimes | F04B 17/03 417/420 |
| 2014/0161651 | A1* | 6/2014 | Grimes | F04B 17/042 417/420 |
| 2015/0240812 | A1* | 8/2015 | Kemnitz | F04B 11/00 417/53 |
| 2015/0357886 | A1 | 12/2015 | Ishizeki et al. | |
| 2016/0138587 | A1* | 5/2016 | Huang | F04C 15/008 417/410.4 |

* cited by examiner

ELECTRO-HYDRAULIC MACHINE WITH INTEGRATED SENSOR

The invention relates to an electro-hydraulic machine, in particular an electro-hydraulic motor-pump unit, for conveying hydraulic fluid in a hydraulic system, with at least one integrated sensor.

BACKGROUND

An electro-hydraulic machine is understood here as a machine which has a pump unit, a drive unit and an associated control unit, designated as a "power pack" for short and in the following as "motor-pump unit (MPU)". In an MPU, various hydraulic pump types can be used for the pump unit and different electric motors for the drive unit. An MPU is primarily intended for converting electric energy into hydraulic energy. Fields of application for MPUs are, for example, modern electric automobiles, mobile work machines and the industrial sector in general. MPUs can also be operated in a generator operation, depending on the electric motor used, so that hydraulic energy from the hydraulic circuit can be converted into electric energy, i.e., MPUs allowing to be operated both in a motor operation as well as in a generator operation are also known.

For example, in applications in the automotive field, the pressure in hydraulic high-pressure systems has hitherto typically been generated by a hydraulic pump coupled to the combustion engine. This is not possible with hybrid or electric vehicles, because a combustion engine is either not constantly running or is not present. In the future, hydraulic pressures will hence be generated by independent electro-hydraulic units, as is an MPU. With MPUs allowing to be operated also in a generator operation energy from the hydraulic circuit can be fed back into the vehicle electric system as electric energy. Especially in the automotive field, MPUs have to meet particular requirements, such as e.g. a very compact, space- and weight-saving construction, high efficiency, long service life under continuous operation, integrated construction, freedom from maintenance and the like.

For example, DE 102 54 670 A1 shows a compact arrangement between motor and pump housing. DE 10 2014 103 959 A1 and DE 10 2014 103 958 A1 respectively describe a motor-pump unit for the usage in chassis systems of motor vehicles, with the motor and the pump being integrated compactly in each other.

The pressure prevailing in the hydraulic system can be captured via a pressure sensor and be reported as an actual state variable to the electronic control unit of the MPU for further use. For pressure capturing there is usually provided a pressure sensor normally in a valve block or an adaptor piece within the hydraulic line network. For supplying the pressure sensor with electric power and for transmitting a pressure measurement signal to the electronic drive unit, the pressure sensor is usually electrically connected via an electrical cabling or a cable harness with the electronic drive unit.

In applications in the exterior region of the vehicle, e.g. in the underbody portion, the pressure sensors and their mechanical and electrical incorporation must be protected from corrosion and against mechanical influences such as for example stone impact.

SUMMARY OF THE INVENTION

It is the object of the invention to improve known MPUs with regard to supplying sensor signals to the control device or feedback control device of an MPU.

The object is in each case achieved with the respective features of one of the independent claims. Further embodiment examples and advantageous developments are defined in the respectively subsequent subclaims. The features and details which are described in connection with the MPU of the invention apply here, of course, also in connection with a hydraulic system having the MPU of the invention and respectively vice versa. Hence, mutual reference is made regarding the disclosure of the individual aspects.

The central idea of the invention is a constructive integration of at least one sensor, for example a pressure sensor, directly in the MPU, preferably in the pump housing. This allows the sensor signal to be supplied to a control unit or feedback control unit of the MPU already upon manufacture of the MPU and also to be tested together with the MPU.

A first aspect of the invention thus relates to an electro-hydraulic motor-pump unit, MPU, having a pump for conveying a hydraulic fluid in a hydraulic system, an electric motor coupled to the pump for driving, a control coupled to the electric motor and arranged for actuating the electric motor, and a housing. According to the invention, the MPU has at least one sensor electrically connected to the control and disposed in a sensor receiving means integrated in the housing.

It should be noted, that the control for actuating the electric motor of the MPU can also be configured such that the electric motor and thus the driven pump can be controlled in terms of a feedback control with respect to one or several target variables taking into account one or several state variables. The term "control" is thus not to be understood as excluding the functionality "feedback control". Rather, "control" includes here both influencing a target variable without but also with feedback.

Preferably, the at least one sensor is outwardly shielded from the outer world by the housing or a corresponding housing part of the MPU. This allows the sensor to be protected against environmental influences by the housing. Also, the sensor is thus not visible from outside.

The at least one sensor may be, for example, a pressure sensor which is in a pressure-sensory contact with a fluid conveyed during operation of the MPU. For this, for example, at a fluid port of the MPU the pressure sensor may be in a pressure-sensory contact with the conveyed fluid.

The pump may be an internal gear pump. Internal gear pumps are known, for example from DE 43 38 875 A1 or EP 1 192 375 A1 and operate according to the displacement principle. An internal gear pump consists substantially of three components: a pump housing, a driven driving gear (pinion) with external teeth, a gear ring (ring gear) engaged with the driving gear with internal teeth and a sickle-shaped filler piece (sickle) integrated fixed to the housing which filler piece is shaped preferably symmetrically to a central plane between the pinion and the ring gear and constitutes gear chambers with the teeth of the pinion and of the ring gear. The pinion and the ring gear run eccentrically, the fluid to be conveyed being conveyed substantially in the gear chambers. The axial extent of the sickle matches the axial extent of the pinion and of the ring gear. For axial sealing, between the gear wheels and the pump housing there is disposed on each side an axial pressure plate which is respectively pressed axially against pinion and ring gear by an axial pressure field generated between the axial pressure plate and the pump housing. The axial pressure plates have bores which are penetrated by a drive shaft for the pinion, and are thus disposed in a plane perpendicular to the axes of the gear wheels. An axial pressure field is formed either in a recess in the pump housing or on the side of the housing in the axial pressure plate and is, in comparison to the sickle, half-sickle-shaped, so that the axial pressure field respectively extends only on one side of the central plane of the sickle. Every axial pressure field is connected, for example, via a bore in the axial pressure plate with the suction chamber or pressure chamber of the pump, depending on the conveying direction of the pump. There is no connection between the two axial pressure fields at an axial pressure plate, i.e., depending on the conveying direction of the pump, in one axial pressure field of the axial pressure plates there is built up the high pressure generated by the pump.

When the pump is designed as an internal gear pump, the at least one pressure sensor can be in pressure-sensory contact with the conveyed fluid at an axial pressure field of the pump.

It should be noted, that a pressure sensor can always be connected via a check-valve circuitry with the respectively high-pressure-containing pressure field of the pump; this can achieve that a pressure sensor always captures the actual high pressure even in the case of an MPU having two conveying directions, in particular a multiquadrant MPU.

The fluid can be, for example, a hydraulic fluid, i.e. hydraulic oil.

The sensor receiving means preferably is integral constituent of one of the structures forming the housing of the MPU. The sensor receiving means is located preferably in a region of the housing in which no functional parts of the MPU are located. Thus, the installation space of the MPU is not substantially changed by the integration of the sensor, in particular not increased.

"Housing" here means the part of the MPU which protectively "houses" and holds the functional components, such as e.g. the pump, the electric motor, the control, the sensor, etc. of the MPU. The term "housing" in connection with the present invention is not to be understood as restricted merely to the envelope of the MPU visible from outside. The term "housing" here explicitly also includes structures lying in the interior of the MPU, such as for example inner walls, bracings, etc. as well as flange parts for connecting two functional units or two parts of a functional unit which are integral with the MPU's constituents forming the envelope of the MPU or are connected thereto and/or receive, envelop or at least hold functional elements of the functional units of the MPU. Hence, the sensor is integrated as an integral constituent of the housing of the MPU into the housing of the MPU in the sensor receiving means, according to the invention.

As already noted, the sensor is not visible from outside, in particular not accessible from outside, due to its arrangement in the sensor receiving means in the housing of the MPU. Thus, the sensor is optimally protected against environmental influences by the housing of the MPU.

The at least one sensor can be a pressure sensor which may be integrated in the housing of the MPU for capturing the pressure in the fluid flowing through the pump, at a pressure-side fluid port of the pump or a suction-side fluid port of the pump. When the pump is an internal gear pump, for capturing the pressure in the fluid flowing through the pump the pressure sensor may be in a pressure-sensory contact with the fluid, where applicable via an auxiliary bore, at a pressure-side axial pressure field of the pump or a suction-side axial pressure field of the pump.

In a preferred embodiment there are provided two pressure sensors for pressure capturing, with respectively one being then integrated at a pressure-side and one at a suction-side hydraulic port of the pump or also in an axial pressure field of the pump as an internal gear pump in the housing of the MPU. In any case, corresponding to the two pressure sensors there is integrated respectively one sensor receiving means according to the invention in the housing of the MPU.

When the MPU can convey or receive fluid in two directions, the two pressure sensors accordingly capture the suction-side or the pressure-side pressure in the fluid alternately. As already noted, a pressure sensor can also be connected via a check-valve circuitry with both fluid ports or in the case of an internal gear pump with the axial pressure fields of the pump such that the pressure sensor is always connected with the high-pressure-containing pressure field; the pressure sensor at the MPU thus always captures the current high pressure.

The MPU can also be adapted as multiquadrant machine, i.e. be operable as a motor and generator.

A pressure sensor can be, depending on the underlying physical principle, a piezoresistive or piezoelectric pressure sensor, a Hall element, a capacitive or inductive pressure sensor.

The sensor receiving means can be configured in the housing such that a pressure-capturing area of the pressure sensor can capture the pressure in the fluid directly or via an auxiliary bore, at a fluid port or, where applicable, at an axial pressure field.

For capturing the pressure, the pressure sensor has a pressure-capturing area with which the pressure sensor during operation of the MPU with the fluid flowing through the pump is in contact with the fluid-containing interior of one of the fluid ports of the MPU directly or via an auxiliary bore which connects the interior of the fluid port with the sensor receiving means.

The housing consists of at least one pump housing part in which functional parts of the pump are received. The sensor receiving means is preferably a structural constituent of the pump housing part.

The housing of the MPU may consist of several housing parts which together define the envelope of the MPU. Then the housing parts are, besides the pump housing part for receiving the functional elements of the pump: a motor housing part for receiving the functional elements of the electric motor and a control housing for receiving the components of the control.

The pump housing part, the motor housing part, and the control housing part may respectively be one- or multi-part.

The individual housing parts can have flanges for connecting two functional units or two housing parts of a functional unit. For example, the pump housing part can have a motor-side pump flange for the connection with a motor housing in which the electric motor is located.

The pump housing part defines in its interior the space for receiving the functional parts of the pump for the conveyance of the hydraulic fluid and for the drivingly coupling to the electric motor.

The interior of the pump housing part can be closed with a pump lid on the side of the pump which is located axially opposite to the motor-side pump flange. Alternatively, the pump housing part can form one end of the housing of the MPU. Preferably, on the motor side the pump housing part is then axially closed with a pump-side motor flange of a motor housing.

For the drivingly coupling to the electric motor, the pump can be connected with the electric motor, for example, via a drive shaft guided through the motor flange.

The suction-side and the pressure-side fluid ports may respectively be located either at the pump housing part or at the pump lid. Preferably, both fluid ports are located at the pump lid. Here, the fluid ports may be designed in the pump lid such that the sensor area of the pressure sensor during operation of the MPU is in direct contact with the fluid. Alternatively, in the pump lid there may be provided an auxiliary bore which produces a communicating connection with the fluid between the interior of a fluid port (or, where applicable, an axial pressure field) and the sensor area of the pressure sensor during operation of the MPU.

In a first variant, the sensor receiving means can extend orthogonally to a longitudinal axis of the MPU defined by the electric motor and the pump.

In this first variant of the sensor receiving means the sensor receiving means can be integrated radially to the longitudinal axis of the MPU in the pump housing part or pump housing lid, for example as a blind hole, such that with an assembled MPU an open end of the sensor receiving means is closed by means of the control housing part of the control. At the end opposing the open end the sensor receiving means is connected directly or via the auxiliary bore with the interior of one of the fluid ports (or, where applicable, an axial pressure field).

The control housing in the first variant can be connected, accordingly with reference to the longitudinal axis of the MPU defined by the pump and the electric motor, radially at the side at least with the pump housing part and can also be connected with the motor housing part. For electrically connecting the electrical ports of the sensor with the control, these can be in direct contact or via intermediate fasteners in a spring-loaded or plugged-in contact with contact points at a circuit of the control.

In a second variant, the sensor receiving means may extend through the pump housing part coaxially to the longitudinal axis defined by the electric motor and the pump.

In this second variant the sensor receiving means extends axially in the, for example as a through hole, through the pump housing part. At a first open end the sensor receiving means can then be closed by means of the pump lid. For sealing, between the pump lid, the pump housing part and the sensor there can be provided a seal. Preferably, it can be an o-ring seal. Preferably, the sensor is inserted in the sensor receiving means from the direction of the pump lid such that its pressure-sensitive sensor area is oriented in the direction of the pump lid.

More preferably, the sensor and the sensor receiving means have form-fittingly cooperating elements, for example a protrusion at the sensor and an edge at the sensor receiving means, which are matched to each other such that the sensor inserted in the sensor receiving means is fixed like a cartridge in a cartridge chamber. In the case of the pressure sensor, the pressure sensor is additionally securely fixed in the sensor receiving means due to the fact that during operation of the MPU the pressure sensor is subjected to the pressure in the hydraulic fluid.

In an alternative embodiment or in addition to the above-described embodiment, the sensor can also have an outside thread and the sensor receiving means can have a corresponding internal thread, so that the sensor can be screwed into the sensor receiving means.

For sealing, a seal, for example, an o-ring seal, can be provided between the pump lid, the pump housing part and the sensor.

In the second variant, the second open end of the sensor receiving means may be superimposed by a through hole in a pump-side motor flange to contact electrical ports of the sensor located on this side. When the pump housing part has a motor-side pump flange, the electrical ports of the sensor are contactable already on account of the sensor receiving means in the form of a through hole. In this embodiment the control housing of the control is connected preferably axially with the motor housing at the motor housing end opposing the pump via a control-side motor flange or a motor-side control housing flange.

For electrically connecting the sensor with the control there are provided fasteners still to be explained which electrically connect the electrical contacts of the sensor through the motor housing with corresponding electrical contacts at a circuit of the control in the control housing in a spring-loaded or plugged-in manner.

The control is preferably arranged for controlling (or feedback-controlling) the electric motor and for energizing the sensor and for requesting a sensor signal supplied by the sensor, for example a pressure signal.

The MPU can have an electrical contact bridge for the sensor, the contact bridge extending axially through the electric motor and connecting electrical ports of the sensor and associated electrical ports of the control.

In a preferred embodiment, the electrical contact bridge consists of form-stable elements having integrated electrical conductor paths and extending in longitudinal direction of the MPU. The conductor paths can be formed of contact plates and be overmold or potted with an electrically insulating plastic material.

Preferably, the conductor paths are shaped such that the conductor paths on the pump side form first contacts for the electrical ports of the sensor and on the control side second contacts for the electrical ports at the control. The conductor paths can be shaped, for example, in an L-shape and have on the sensor side corresponding contact areas for resilient contact pins at the associated sensor and on the control side corresponding plug-in contacts for a plug-in-type connection with a plug of the control or with a plug-in contact disposed in a circuit board of the control.

Via the electrical contact bridges, i.e. the conductor paths, the sensor is energized (fed) by the control with the necessary electric power and the sensor signal generated by the sensor is led to the control or requested by the control.

For example, a sensor can be a pressure sensor having three electrical contacts. Accordingly, a contact bridge then has three conductor paths. By means of the contact bridges there is effected the electrical linking of the pressure sensor to the control unit within the motor housing and is thus protected against environmental influences and not visible from outside. The electrical pressure signal which is generated at the measurement site proportionally to the pressure prevailing there in the fluid is forwarded to the control unit via the contact bridge by the pressure sensor.

In a development of the MPU, the control has a data interface to a communication bus, in particular to a CAN bus or field bus or the like, and is arranged to supply the sensor signal captured on the part of at least one sensor or a data word corresponding to the sensor signal to the communication bus.

In particularly preferred implementations of the MPU there are integrated at least two pressure sensors in the housing of the MPU, a first pressure sensor being in pressure-sensory contact with the fluid for capturing the pressure in the fluid at the first fluid port of the pump and a second pressure sensor for capturing the pressure in the fluid at a second fluid port of the pump. As already described above, the pressure sensors can be in pressure-sensory contact with the fluid also at corresponding axial pressure fields of the pump, when the pump is an internal gear pump. If the MPU is a multiquadrant machine, the two pressure sensors are alternately in a pressure-sensory connection with the suction-side or the pressure-side fluid port, depending on the actual conveying direction.

A second aspect of the invention relates to a fluid system which comprises fluid lines and an MPU according to the first aspect of the invention connected to the fluid lines with at least one integrated sensor in the form of a pressure sensor. The fluid can be, for example, a hydraulic fluid. Such a hydraulic system, for example, can be constituent of a motor vehicle, a work machine etc.

An MPU improved according to the invention, in the scenario described at the beginning with an MPU in a hydraulic system and separate pressure sensors for capturing the pressure in the hydraulic fluid, has numerous advantages:

First, a danger of a pressure sensor now no longer being disposed externally being damaged is excluded. Due to the robust and protected integration of the pressure sensor in the housing of the MPU this is protected from corrosion and mechanical damage. This enables, in particular, the use of sensors not having particular mechanical protective measures against corrosion or damage.

The assembly effort of an overall system is simplified in several points: The one or more pressure sensors do not have to be adapted mechanically in the hydraulic system. As the sensors can already be electrically tuned upon integration in the MPU (e.g. offset correction), this is not necessary later in the overall system. No extra installation space is required for the pressure sensor. The MPU is more compact and the packaging is better suitable for the usage in motor vehicles. The effort of electrically linking one or several pressure sensors in the system, e.g. cable harness installation etc. is eliminated. As no external linking of the pressure sensors is necessary, the usual potential defects in cable harnesses, such as cable rupture, tear off, corrosion of contact points, are excluded. Doing without the electrical linking reduces the assembly effort accordingly. As no pressure sensors must be installed, an interchanging of electrical ports, e.g. by erroneous plug-in, is excluded.

Due to the integrated pressure sensor, the control of the MPU has its "own" pressure signal, i.e. a feedback of the actual state variable, this allows the control to feedback-control the electric motor as a drive of the pump, for example for reporting pressure pulsations in the hydraulic fluid. Thus, an additional pressure sensor is no longer required in the system. The control can report the MPU-internally captured pressure signal(s) to further control devices via corresponding interfaces, such as e.g. to the CAN bus.

As by the integration of the pressure sensor in the MPU the pressure sensor and the MPU are in a way force-coupled, the two are checked together, accordingly. I.e., upon manufacture and EOL test of the MPU it is tested already with the associated pressure sensors.

The above-mentioned advantages which were explained with the help of a pressure sensor as an embodiment example of a sensor integrated in the MPU, can also be realized for other sensors accordingly.

Figure 2:
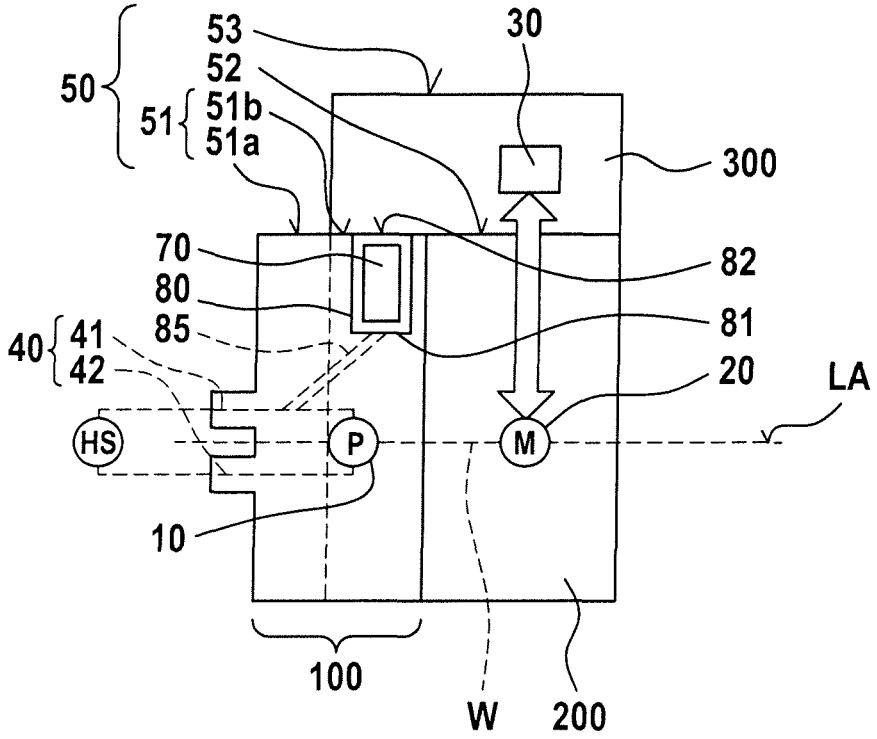
Figure 3:
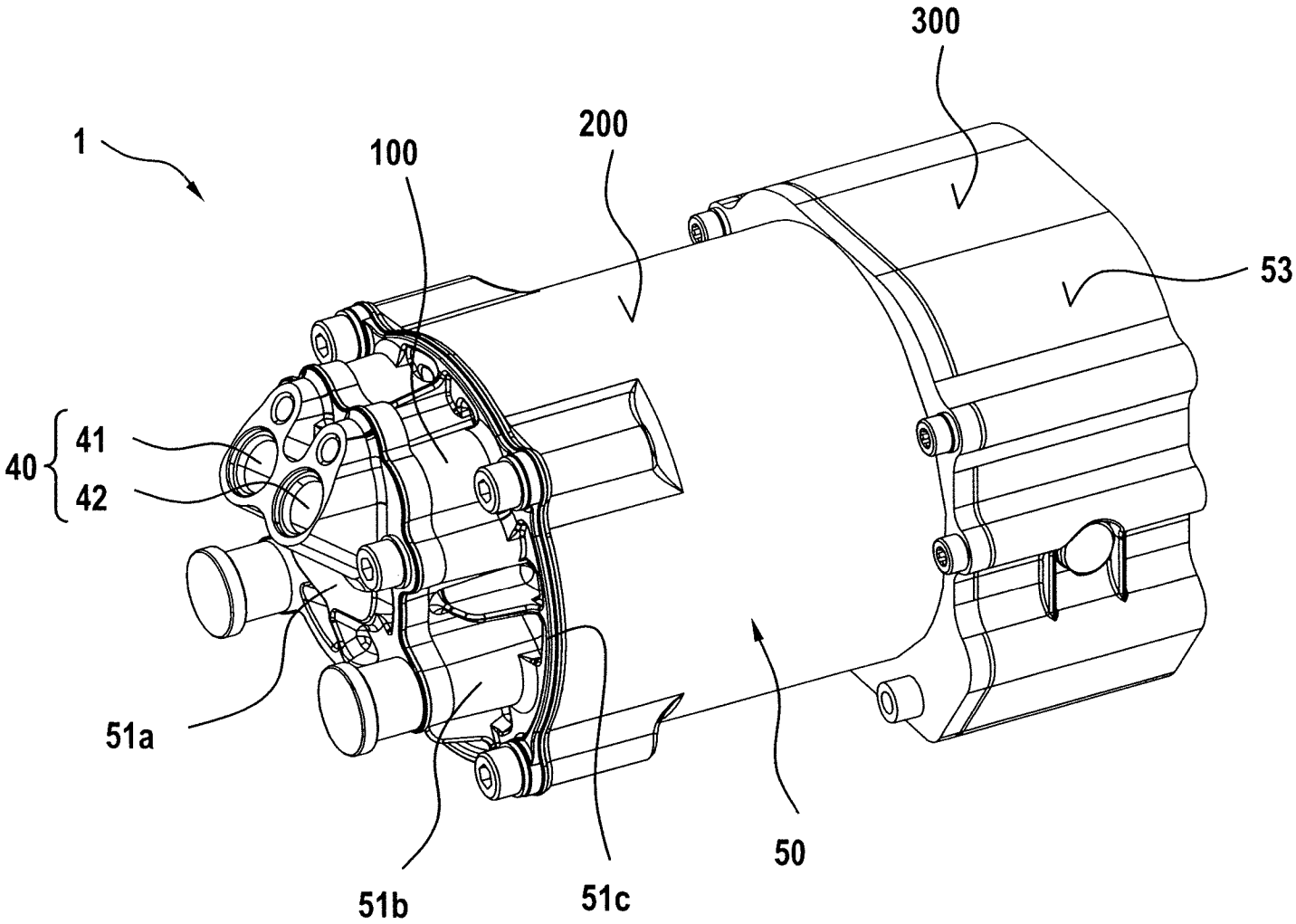
Figure 4:
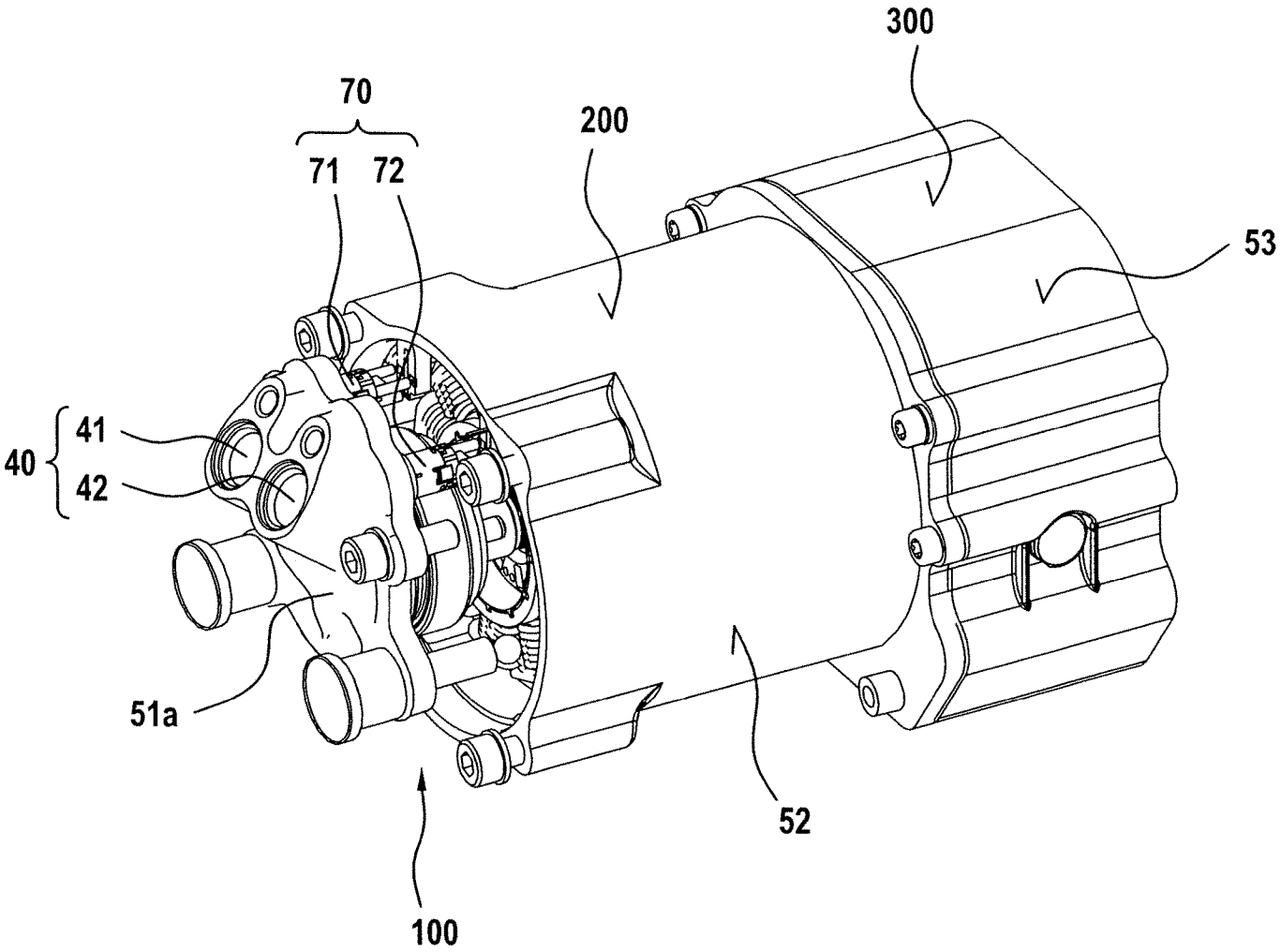
Figure 5:
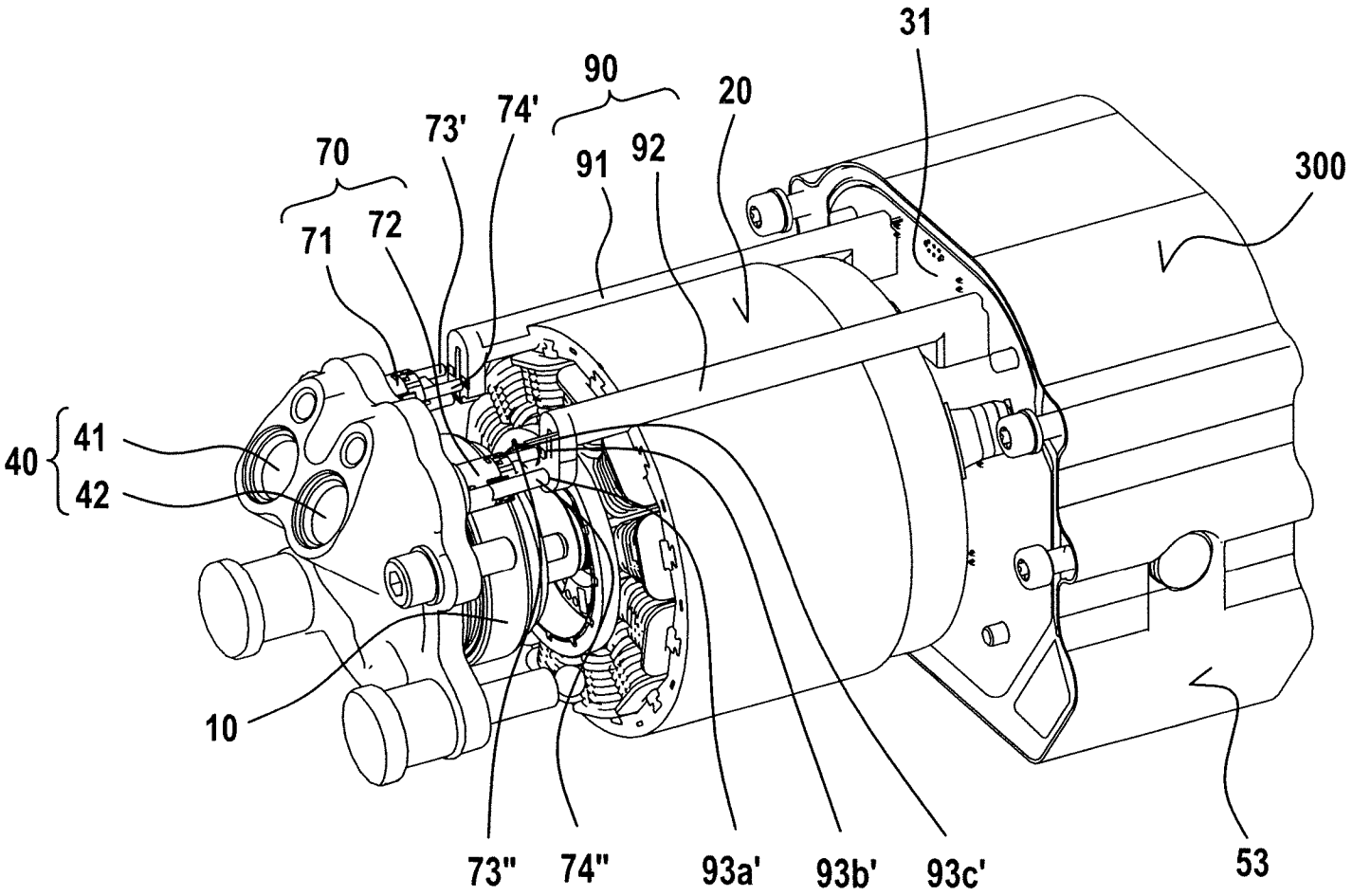
Figure 6:
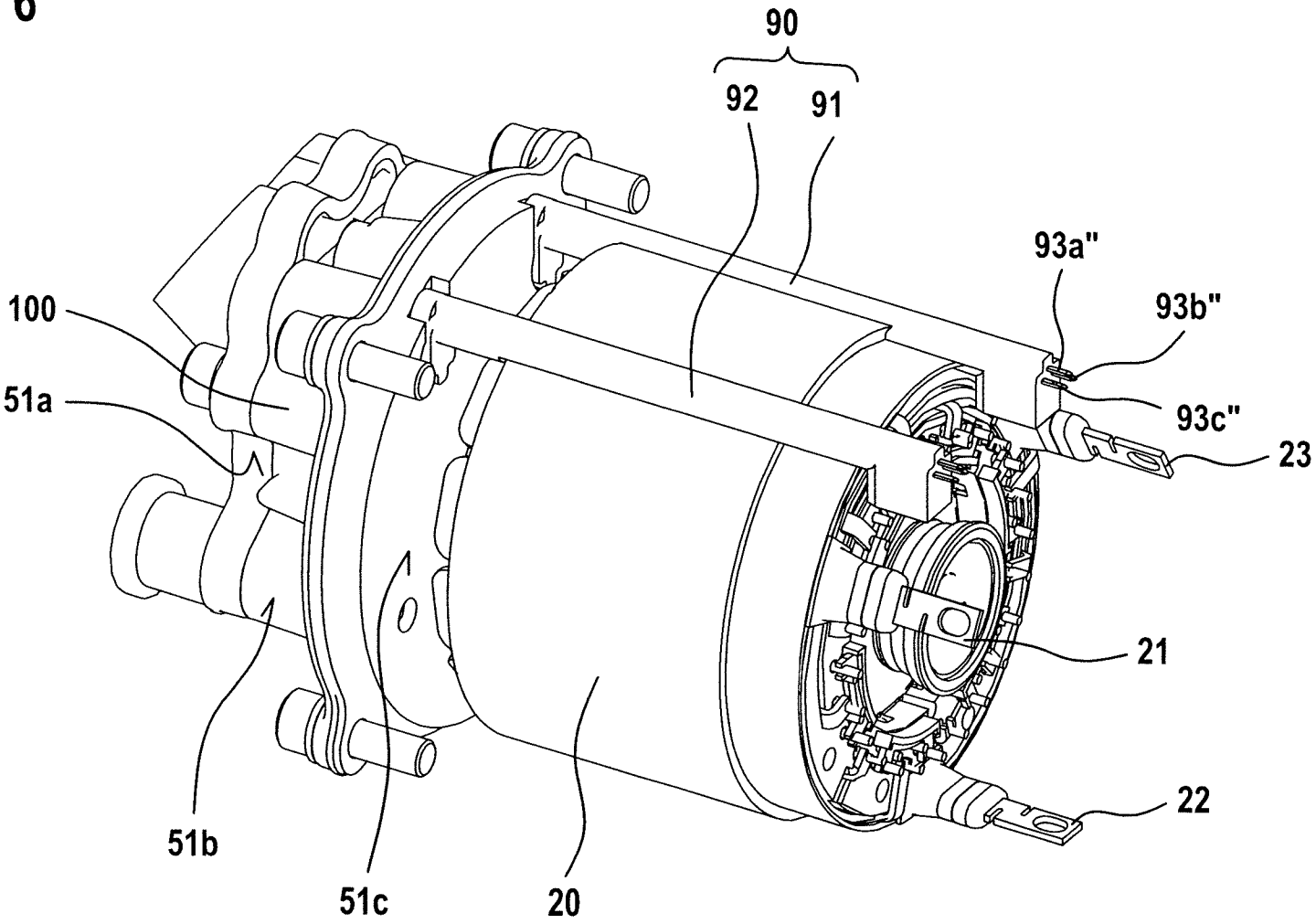
Figure 7:
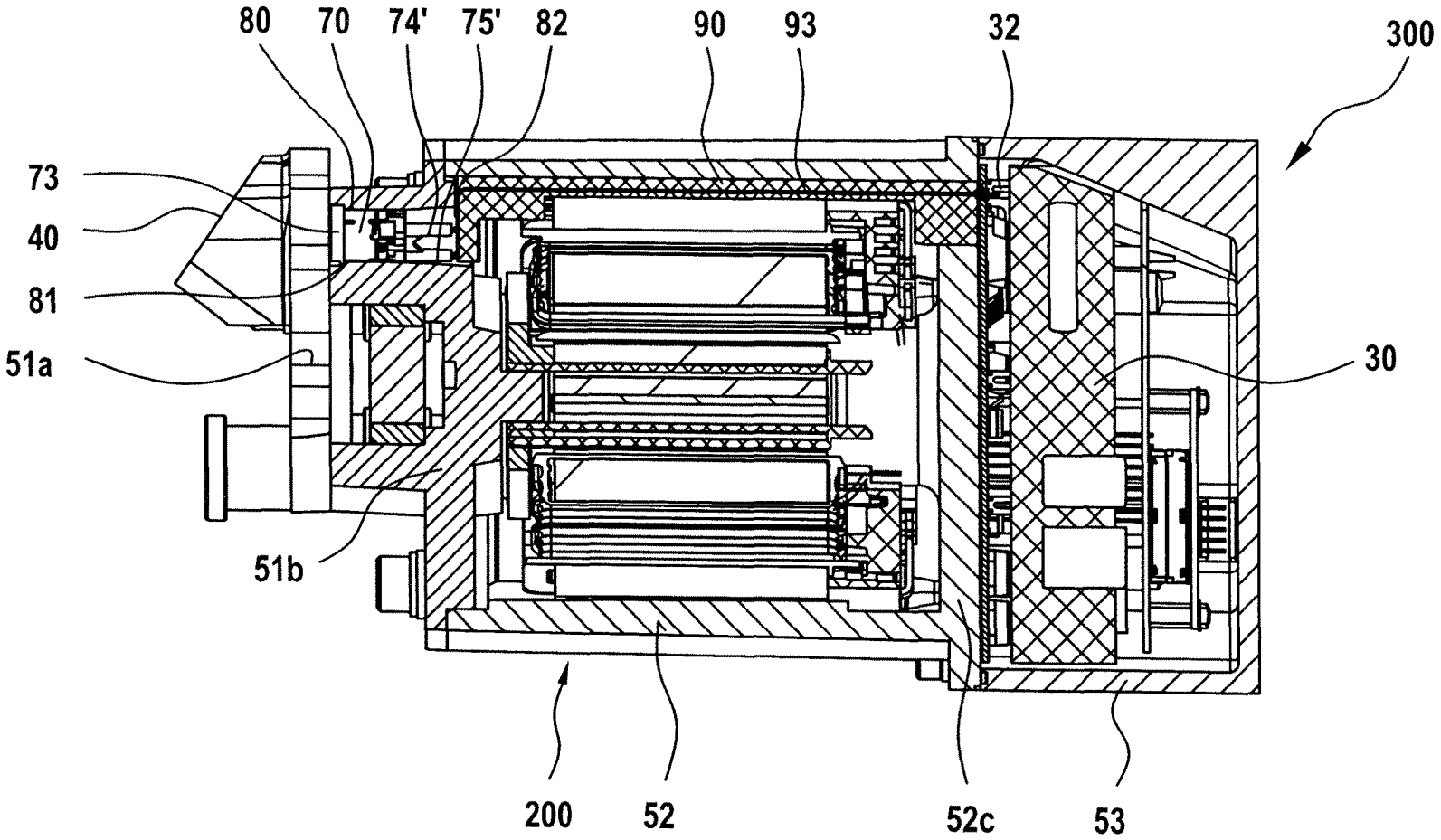
Figure 8:
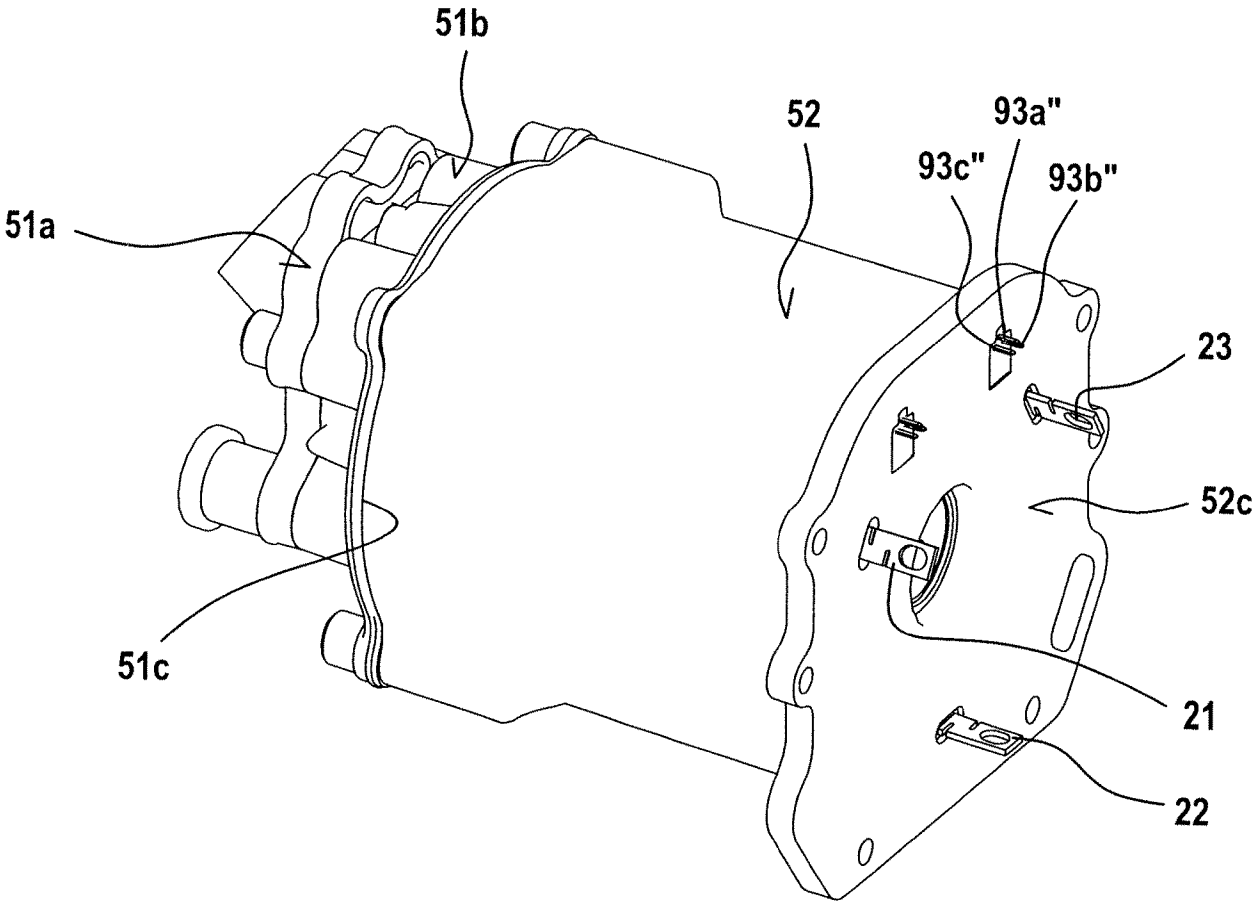

Further advantages, features and details of the invention will result from the following description, in which exemplary embodiments of the invention will be described in detail with reference to the drawings. The features mentioned in the claims and in the description may be essential to the invention individually per se or in arbitrary combination. Likewise, the hereinabove mentioned features and those specified hereinbelow may be employed each per se or in groups in arbitrary combination. Functionally similar or identical members or components are furnished in part with the same reference signs. The terms "left", "right", "above" and "below" used in the description of the embodiment examples relate to the drawings as oriented with the figure designation or reference signs in the normally legible way. The shown and described embodiment is not to be understood as exhaustive, but has an exemplary character for explaining the invention. The detailed description primarily is for the skilled person's information, so that known circuits, structures and methods are not shown or explained in detail in the description so as not to impede the understanding of the present description. Hereinafter the invention will be described by way of example with reference to the accompanying drawings. Therein are shown:

FIG. 1 a schematic sectional representation of the integral arrangement of a pressure sensor in an MPU according to a first embodiment;

FIG. 2 a schematic sectional representation of the integral arrangement of a pressure sensor in an MPU according to an alternative embodiment;

FIG. 3 a perspective view of an MPU according to the first embodiment;

FIG. 4 the perspective view of the MPU of FIG. 3 with the pump housing part omitted;

FIG. 5 the perspective representation of the MPU of FIG. 4 with the motor housing part omitted;

FIG. 6 a perspective view of the MPU of FIGS. 3-5 without electronic drive unit and without motor housing;

FIG. 7 a sectional representation of the MPU of FIGS. 3-6;

FIG. 8 a perspective representation of the MPU of FIG. 3 without electronic drive unit and thus with a view onto the interface between motor unit and electronic drive unit.

In the hereinafter described embodiment examples the sensor integrated in an MPU is a pressure sensor. This, however, is not to be understood such that the integration of a sensor in an MPU as suggested herein is restricted to pressure sensors. Rather, also other sensors can be advantageously integrated in an MPU in the manner suggested herein.

The FIGS. 1 and 2 respectively show a schematic sectional representation with an integral arrangement of a pressure sensor in an electro-hydraulic motor-pump unit, MPU 1, 2 according to a first and according to an alternative embodiment.

The MPU 1 of FIG. 1 and the MPU 2 of FIG. 2 substantially consist of three functional units: a pump unit 100 with a pump 10 for conveying a hydraulic fluid in a hydraulic system HS; a drive unit 200 having an electric motor 20 and coupled to the pump unit 100 for driving the pump 10; and a control unit 300 having a control 30 and coupled to the drive unit 200 and arranged for actuating or feedback-controlling the electric motor 20.

The control 30 is arranged for controlling (or feedback-controlling) the electric motor 20 and for energizing the pressure sensor 70 and for requesting a sensor signal supplied by the pressure sensor 70. The pressure sensor 70 can be, depending on the underlying physical principle, a piezoresistive or piezoelectric pressure sensor, a Hall element, a capacitive or inductive pressure sensor; basically, also other physical principles not mentioned herein or future ones are conceivable for the pressure measurement in a sensor to be integrated into the MPU.

The pump 10, the electric motor 20 and the control 30 are housed by a housing 50 of the respective MPU 1, 2. As already explained at the outset, "housing 50" here is understood to be the part of the MPU 1, 2 which protectively receives and holds the pump 10, the electric motor 20, the control 30 etc. of the MPU 1, 2. The feature "housing 50" in connection with the present invention is not to be understood as restricted to the envelope of the MPU 1, 2 visible from outside. The feature "housing 50" also comprises structures in the interior of the MPU 1, 2 which are integral to the constituents forming the envelope of the MPU or are connected thereto. Structures in the interior of the MPU 1, 2 may be, for example, inner walls, braces, etc., but also flange parts for connecting two functional units or two parts of a multipart functional unit. I. e., the housing 50 is formed by such parts of the MPU 1, 2 which receive, envelop or at least hold functional elements of the functional units 100, 200, 300 of the MPU.

The housing 50 of the MPU 1, 2 consists of several housing parts 51, 52, 53 which together form the housing 50 of the MPU 1, 2. In the variants of the FIGS. 1 and 2, the housing parts are a pump housing 51 for receiving the functional components of the pump 10, a motor housing 52 for receiving the functional components of the electric motor 20 and a control housing 53 for receiving the components of the control 30.

Basically, at least one housing part (pump housing 51, the motor housing 52 and the control housing 53) can be one- or multi-part. In the implementations of the FIGS. 1 and 2, the pump housing 51 is of two-part design and has a housing lid 51*a* and a pump housing part 51*b*.

It should be noted that the pump housing 51 can have only the pump housing part 51*b* which then forms one end of the housing 50 of the MPU 1, 2. In this case, the pump housing part 51*b* can then be axially closed on the motor side with a pump-side motor flange of the motor housing 52.

The pump housing part 51*b* defines in its interior the space for receiving the functional parts of the pump 10 for the conveyance of the hydraulic fluid and for the drivingly coupling to the electric motor 20. The pump 10 is coupled to the electric motor 20 via a drive shaft W led through a motor-side pump flange.

In both implementations at least one pressure sensor 70 is integrated in the housing 50 of the MPU 1, 2 by the pressure sensor 70 being disposed in a sensor receiving means 80 integrated in the housing 50. This achieves that with a mounted MPU 1, 2 the pressure sensor 70 is not accessible through the housing 50 from outside and thus shielded from environmental influences. The sensor receiving means 80 is an integral constituent of the housing 50 of the MPU 1, 2. Thus, the pressure sensor 70 located in the sensor receiving means 80 is integrated in the housing 50 of the MPU 1, 2.

In the embodiment of FIG. 1, the pressure sensor 70 is electrically connected with the control 30 via a contact bridge 90 through the motor unit 200. In the embodiment of FIG. 2, the pressure sensor 70 is electrically connected directly with the control 30 arranged adjacent to the pressure sensor 70.

The pressure sensor 70 located in the sensor receiving means 80 is at a hydraulic port 41 of the MPU 1, 2 in pressure-sensory contact with the hydraulic fluid conveyed by means of the pump 10 during operation of the MPU 1, 2 in order to capture the hydraulic pressure present there in the hydraulic fluid. For capturing the pressure, the pressure sensor 70 has a pressure-capturing area 73 via which the pressure sensor 70 during operation of the MPU 1, 2 with the hydraulic fluid flowing through the pump 10 is in contact with the hydraulic fluid-containing interior of one of the hydraulic ports 40 of the MPU 1, 2 via an auxiliary bore 85 which connects the interior of the hydraulic port 41 with the sensor receiving means 80.

Between pump lid 51*a* and pump housing part 51*b* or, if the pump housing consists of only the pump housing part 51*b*, between pump housing part 51*b* and the pressure sensor 70 there is disposed a seal not shown in the FIG. 1 to seal the sensor receiving means 80 against the hydraulic fluid.

When the pump 10 is a displacement pump in the form of an internal gear pump, the pressure sensor 70 can be in pressure-sensory contact with an axial pressure field of the pump alternatively directly or via an auxiliary bore.

In the schematic sectional representation of FIG. 1 an MPU-integral arrangement of a pressure sensor 70 according to the first embodiment is shown. Here the sensor receiving means 80 extends coaxially to a longitudinal axis LA of the MPU 1 defined by the electric motor 20 and the pump 10 through the pump housing part 51*b*. The sensor receiving means 80 extends axially as a through hole through the pump housing part 51*b* and is thus integrated in the pump housing part 51*b*.

At a first open end 81 the sensor receiving means 80 is closed by means of the pump lid 51*a*. The pressure sensor 70 is inserted in the sensor receiving means 80 from the direction of the pump lid 51*a* similar to a cartridge in a cartridge chamber, such that its pressure-sensitive sensor area 73 is oriented in the direction of the pump lid. Alternatively, the pressure sensor 70 can also be screwed via corresponding threads at the sensor and at the sensor receiving means in the pump housing part 51*b*. At the pump lid 51*a* there are located two hydraulic ports 41, 42 of the pump 10. In the pump lid 51*a* there is provided an auxiliary bore 85 via which, during operation of the MPU 1, a pressure-sensory contact between a sensor area of the pressure sensor 70 with the hydraulic fluid at the hydraulic port 41 is established.

A second open end 82 of the sensor receiving means 80 may be superimposed by a through hole in a pump-side motor flange to contact electrical ports of the sensor 70 located on this side. When the pump housing part 51*b* has a motor-side pump flange, the electrical ports of the pressure sensor 70 are contactable already on account of the sensor receiving means 80 in the form of the through hole.

In the embodiment of FIG. 1 the control housing 53 of the control unit 300 is connected preferably axially with the motor housing 52 at the motor housing 52 end opposing the pump unit 100 via a control-side motor flange or a motor-side control housing flange.

For electrically connecting the pressure sensor 70 with the control 30 there are provided contact bridges 90 as fasteners which produce an electrical connection through the motor housing 52 between electrical contacts of the pressure sensor 70 and corresponding electrical contacts at a circuit board 31 of the control 30 in the control housing 53.

In the schematic sectional representation of FIG. 2 an MPU-integral arrangement of a pressure sensor 70 according to an alternative embodiment is shown. Here the sensor receiving means 80 extends orthogonally to the longitudinal axis LA of the MPU 2 defined by the electric motor 20 and the pump 10 in the pump housing part 51*b*.

The sensor receiving means 80 is integrated as a blind hole radially to the longitudinal axis of the MPU 2 in the pump housing part 51*b* such that in an assembled MPU 2 an open end 82 of the sensor receiving means 80 is closed by means of the control housing part 53 of the control 30. At the end 81 opposing the open end 82 the sensor receiving means 80 is connected with the interior of the hydraulic port 41 via the auxiliary bore 85. Here, too, the pressure sensor 70 can be screwed via corresponding threads at the sensor 70 and at the sensor receiving means 80 in the pump housing part 51*b*.

In this embodiment too, for sealing the sensor receiving means 80 there is disposed a seal (not shown in FIG. 2) between pressure sensor 70 and pump housing part 51*b* to seal the sensor receiving means 80 against the hydraulic fluid.

In this embodiment too, when the pump 10 is a displacement pump in the form of an internal gear pump, the pressure sensor 70 can be in pressure-sensory contact with an axial pressure field of the pump alternatively directly or via an auxiliary bore.

The control housing 53 in this embodiment is connected, accordingly with reference to the longitudinal axis LA of the MPU 2 defined by the pump 10 and the electric motor 20, radially at the side at least with the pump housing part 51*b* and with the motor housing part 52.

For the functional electrical connection of the electrical ports of the pressure sensor 70 with the control 30, in the second embodiment these can be in a direct electrical contact or likewise via intermediate fasteners in a preferably spring-loaded or plugged-in contact with contact points at a circuit board of the control 30.

In the following, with reference to FIGS. 3 to 8 there is explained in detail a preferred embodiment example of an MPU 1 which substantially corresponds to the embodiment in FIG. 1.

FIG. 3 shows a perspective view of the MPU 1. The MPU 1 consists of the pump unit 100 with a pump 10 for conveying a hydraulic fluid in a hydraulic system, a motor unit 200 coupled to the pump unit 100 for driving the pump 10, a control unit 300 coupled to the motor unit 200 and arranged for actuating the electric motor. All functional units are enveloped by a housing 50 of the MPU 1.

The housing 50 is formed by several housing parts, namely the pump housing 51, the motor housing 52 and the control housing 53. The pump housing 51 is of a two-part design and consists of a pump lid 51*a* and a pump housing part 51*b*. At the pump lid 51*a* there are located two hydraulic ports 41, 42 of the pump unit 100.

FIG. 4 shows the perspective view of the MPU 1 of FIG. 3 with the pump housing part 51*b* omitted. Compared to FIG. 3, in FIG. 4 there can now be recognized the two pressure sensors 71, 72 disposed in the housing 50, namely in the pump housing part 51*b*, shielded from the outside by the housing 50 and electrically connected with the control unit 300. By omitting the pump housing part 51*b*, one can readily see that the pump housing part 51*b* in its interior forms the space for receiving the functional parts of the pump 10 for conveying the hydraulic fluid and for the drivingly coupling to the electric motor 20.

The pump is designed as an internal gear pump, in the pump housing part 51*b* there are thus substantially disposed: a driven pinion with external teeth, a gear ring with internal teeth engaged with the pinion and a sickle-shaped filler piece integrated fixed to the housing, which is formed symmetrically to a central plane between the pinion and the gear ring and forms gear chambers with the teeth of the pinion and the ring gear.

The pump 10 is coupled to the electric motor 20 via a drive shaft led through the motor-side pump flange 51*c* (FIG. 6) for driving the pinion of the pump 10.

For axial sealing, between the gear wheels and the pump housing part 51*b* on one side and the pump lid 51*a* on the other side there is disposed respectively one axial pressure plate (not shown) which is respectively pressed axially against pinion and gear ring by an axial pressure field generated between the axial pressure plate and the pump housing part 51*b* or pump lid 51*a*. The axial pressure plates have bores which are penetrated by a drive shaft for the pinion, and are thus disposed in a plane perpendicular to the axes of the gear wheels. An axial pressure field is formed either in a recess in the pump housing part 51*b* or pump lid 51*a* or on the side of the housing in the respective axial pressure plate and is, in comparison to the sickle (not shown), half-sickle-shaped, so that the axial pressure field respectively extends only on one side of the central plane of the sickle.

Every axial pressure field is connected, for example, via a bore in the axial pressure plate with the suction chamber or pressure chamber of the pump 10, depending on the conveying direction of the pump. There is no connection between the two axial pressure fields at an axial pressure plate, i.e., depending on the conveying direction of the pump, in one axial pressure field of the axial pressure plates there is built up the high pressure generated by the pump and in the other axial pressure field the suction pressure.

In the pump 10 having the form of an internal gear pump the pressure sensors 71, 72 are respectively in pressure-sensory contact with the conveyed hydraulic fluid at one of the two axial pressure fields of the pump on the side of the pump housing part. The pressure captured at the respective axial pressure field corresponds to the suction-side or the pressure-side pressure in the hydraulic fluid, respectively. Thus, in the embodiment example shown here, two pressure sensors 71, 72 are integrated in the housing 50 of the MPU 1. A first one of the pressure sensors 71 is arranged for capturing the pressure in the hydraulic fluid at a first one 41 of the hydraulic ports 40 and a second one of the pressure sensors 72 for capturing the pressure in the hydraulic fluid at a second one 42 of the hydraulic ports 40. The MPU 1 is designed as a multiquadrant machine and accordingly the pressure sensors 71, 72 capture, according to a current flow direction of the hydraulic fluid, the suction-side or the pressure-side hydraulic pressure, respectively.

FIG. 5 shows the perspective representation of the MPU 1 of FIGS. 3 and 4, in comparison to FIG. 4 in addition also the motor housing part 52 being omitted. One can readily recognize here that the interior of the pump housing part 51*b* is closed with the pump lid 51*a* on the side of the pump unit 100 located axially opposite to the motor-side pump flange 51*c* (FIG. 6).

FIG. 6 shows a perspective view of the electro-hydraulic motor-pump unit (MPU) of the FIGS. 3-5 without control unit 300 and without motor housing 52. In FIG. 6 one can readily recognize, in addition to the representations of FIGS. 3 to 5, that the pump housing part 51*b* has a motor-side pump flange 51*c* for the connection with the motor housing 52 in which the electric motor 20 is located.

FIGS. 5 and 6 show the contract bridges 91, 92 for electrically connecting the pressure sensor 70 with the control unit 300. The contact bridges 91, 92 extend axially through the motor unit 200 and connect electrical ports 74', 75' of the pressure sensor 70 and associated electrical ports 32 of the control 30.

The electrical contact bridges 91, 92 are elongate, form-stable elements with integrated electrical conductor paths 93. The conductor paths 93 were respectively punched out of contact plate, subsequently reshaped, and then overmold or potted with an electrically insulating plastic material.

The conductor paths 93 have been formed in L-shaped manner in the shown embodiment, so that the conductor paths 93 have on the pump side first contacts 93*a'*, 93*b'*, 93*c'* for associated electrical ports 73', 74', 75', 73", 74", 75" of one of the pressure sensors 71, 72 and on the control side second contacts 93*a*", 93*b*", 93*c*" for electrical ports 32 at the control 30.

By means of the electrical contact bridges 91, 92, i.e. the respective conductor paths 93, the pressure sensors 71, 72 are fed with the necessary electric power by the control 30 and the electrical pressure signal generated proportionally to the prevailing pressure at the hydraulic port 41, 42 by the respective pressure sensor 71, 72 associated therewith is requested by the control 30.

By the electrical linking of the pressure sensors 71, 72 to the control 30 being effected through the motor housing 52 and therefore therein, the electrical linking of the pressure sensors 71, 72 is protected, like the pressure sensors 71, 72 themselves, by the housing 50 from environmental influences and likewise is not visible from outside.

FIG. 7 shows a sectional representation through the MPU of the FIGS. 3-6. In FIG. 7 one can readily recognize that the housing 50 the MPU 1 has the pump housing part 51*b* in which functional parts of the pump 10 are held and housed, and in particular that the sensor receiving means 80 is structural constituent of the pump housing part 51*b*. The sensor receiving means 80 extends coaxially to the longitudinal axis LA defined by the motor unit 200 and the pump unit 100 as a through hole through the pump housing part 51*b*.

The pressure sensor 70 is at one of the hydraulic ports 41, 42 of the MPU 1 via an auxiliary bore not shown in FIG. 7 in pressure-sensory contact with the hydraulic fluid conveyed during operation of the MPU 1. The sensor receiving means 80 is configured in the pump housing part 51*b* such that a pressure-capturing area of the pressure sensor 70 can capture the pressure in the hydraulic fluid via the not shown auxiliary bore at one of the fluid ports 41, 42.

At a first open end 81 the sensor receiving means 80 is closed by means of the pump lid 51*a*. The pressure sensor 70 is inserted in the sensor receiving means 80 from the direction of the pump lid 51*a* such that its pressure-sensitive sensor area 73 is oriented in the direction of the pump lid 51*b*.

The pressure sensor 70 and the sensor receiving means 80 have form-fittingly cooperating elements, for example a circumferential protrusion at the pressure sensor 70 and a respective circumferential edge at the sensor receiving means 80. Protrusion and edge are matched to each other such that the pressure sensor 70 inserted in the sensor receiving means 80 is fixed like a cartridge in a cartridge chamber. For sealing the sensor receiving means 80 against the hydraulic fluid an o-ring seal not shown in detail in FIG. 7 is provided.

At the pump lid 51*a* there are located the hydraulic ports 40 of the pump 10. The hydraulic ports 40 and the sensor receiving means 80 can be designed such that the sensor area 73 of the pressure sensor 70 during operation of the MPU 1 is in direct contact with the hydraulic fluid at the associated hydraulic port 40. In the embodiment of FIGS. 3 to 8, in the pump lid there is provided an auxiliary bore not shown in FIG. 7, via which the sensor area 73 of the pressure sensor 70 during operation of the MPU 1 is in contact with the hydraulic fluid at the associated hydraulic port 40. By the pressure sensor 70 being subjected to the pressure in the hydraulic fluid during operation of the MPU 1, the pressure sensor 70 is additionally securely fixed in the sensor receiving means 80.

By the pump housing part 51*b* in this embodiment having the motor-side pump flange 51*c*, the electrical ports of the pressure sensor 70 are contactable by the contact bridges 91, 92 already on account of the sensor receiving means 80 in the form of the through hole. Alternatively, the second open end 82 of the sensor receiving means 80 could be brought into congruence with a through hole in a pump-side motor flange, so that the electrical ports of the pressure sensor 70 located on this side again are contactable by means of the contact bridges 91, 92.

The control housing 53 of the control unit 300 having control 30 is connected axially with the motor housing 52 at the motor housing 52 end opposing the pump unit 100 via a control-side motor flange 52*c* (FIG. 8). Alternatively, the connection could also be established via a motor-side control housing flange.

FIG. 8 shows a perspective representation of FIG. 3 without electronic drive unit and view onto the interface between motor unit and electronic drive unit. Besides the already explained housing parts of pump lids 51*a*, pump housing part 51*b*, motor housing part 52, in FIG. 8 due to omitting the control unit 300 one can readily recognize the control-side motor housing flange 52*c*. In the motor housing flange 52*c* there are located first through openings through which electrical ports 21, 22, 23 of the windings of the electric motor 20 are led, and second through openings through which the control-side second contacts 93*a*", 93*b*", 93*c*" of the contact bridges for electrical ports 32 at the control 30.

Finally, it should be noted that the control unit 300 has a data interface not represented in the Figures for linking to a communication bus, for example a CAN bus or field bus or the like, and is arranged, besides other communication purposes, for providing hydraulic pressures captured on the part of the two pressure sensors 71, 72 to the communication bus.

The invention claimed is:

1. An electro-hydraulic motor-pump unit, MPU, comprising:

a pump for conveying a fluid;

an electric motor coupled to the pump for driving;

a control coupled to the electric motor and arranged for actuating the electric motor;

a housing; and at least one sensor electrically connected to the control and disposed in a sensor receiving means integrated in the housing, wherein the housing has a pump housing part in which functional elements of the pump are received, a motor housing part in which functional elements of the electric motor are received, and a control housing part in which functional elements of the control are received, and wherein the sensor receiving means is a structural constituent of, and exclusive to, the pump housing part.

2. The MPU according to claim 1, wherein the at least one sensor is shielded from the outside by the housing.

3. The MPU according to claim 1, wherein the at least one sensor is a pressure sensor which is in pressure-sensory contact with fluid conveyed during operation of the MPU at a fluid port of the MPU.

4. The MPU according to claim 1, wherein the pump is an internal gear pump and the at least one sensor is a pressure sensor, wherein the at least one pressure sensor is in pres sure-sensory contact with the fluid in an axial pressure field of the pump.

5. The MPU according to claim 3, wherein the sensor receiving means in the housing is configured such that a pressure-capturing area of the pressure sensor can capture the pressure in the fluid directly or via an auxiliary bore.

6. The MPU according to claim 1, wherein the pump housing part has a motor-side pump flange for connection with the motor housing part.

7. The MPU according to claim 6, wherein an interior of the pump housing part is closed with a pump lid on a side of the pump located axially opposite to the motor-side pump flange.

8. The MPU according to claim 6, wherein a suction-side and a pressure-side fluid port are respectively located either at the pump housing part or at a pump lid.

9. The MPU according to claim 1, wherein the pump housing part forms one end of the housing of the MPU, and wherein the pump housing part on the motor side is axially closed with a pump-side motor flange of the motor housing part.

10. The MPU according to claim 1, wherein the sensor receiving means extends orthogonally to a longitudinal axis of the MPU defined by the electric motor and the pump.

11. The MPU according to claim 1, wherein the sensor receiving means extends coaxially to a longitudinal axis defined by the electric motor and the pump through the pump housing part.

12. The MPU according to claim 1, wherein the MPU has an electrical contact bridge for the at least one sensor, and wherein the contact bridge extends axially through the electric motor and connects electrical ports of the at least one sensor and associated electrical ports of the control.

13. The MPU according to claim 12, wherein the electrical contact bridge is formed of form-stable elements having integrated electrical conductor paths extending in a longitudinal direction of the MPU, which are overmold or potted with an electrically insulating plastic material and are L-shaped, such that the conductor paths on the pump side form first contacts for electrical ports of the at least one sensor and on the control side second contacts for electrical ports at the control.

14. The MPU according to claim 1, wherein the control has a data interface to a communication bus, and is arranged to supply fluid pressure captured on part of the at least one sensor to the communication bus.

15. The MPU according to claim 1, wherein the at least one sensor comprises at least two pressure sensors that are integrated in the housing of the MPU, wherein a first pressure sensor for capturing pressure in the fluid is in pressure-sensory connection at a first fluid port of the pump and a second pressure sensor for capturing the pressure in the fluid is in pressure-sensory connection at a second fluid port of the pump.

16. A hydraulic system comprising hydraulic lines, and connected to the hydraulic lines, an MPU according to claim 1 with at least one integrated pressure sensor.

* * * * *